United States Patent [19]

Turner et al.

[11] Patent Number: 4,815,619

[45] Date of Patent: Mar. 28, 1989

[54] MEDICAMENT VIAL SAFETY CAP

[76] Inventors: Thomas R. Turner, 2262 Lusardi Dr., San Jose, Calif. 94148; Bernard M. Kraemer, 43555 Grimmer Blvd. #A210, Fremont, Calif. 94533; Michael L. Harrison, 1083 Di Napoli Dr., San Jose, Calif. 95129

[21] Appl. No.: 72,719

[22] Filed: Jul. 13, 1987

[51] Int. Cl.[4] ..... B65D 41/00

[52] U.S. Cl. ..... 215/248; 215/DIG. 3

[58] Field of Search ..... 215/248, DIG. 3; 604/126, 415

[56] References Cited

U.S. PATENT DOCUMENTS

| | | | |
|---|---|---|---|
| 744,617 | 11/1903 | Ritsert | 215/248 |
| 1,189,465 | 7/1916 | Mayo | 215/DIG. 3 |
| 2,061,958 | 11/1936 | Chapman | 215/248 |
| 2,186,888 | 1/1940 | Tullar et al. | 215/DIG. 3 |
| 2,186,908 | 2/1939 | Page et al. | 215/248 |
| 3,778,971 | 12/1973 | Granger et al. | 604/126 |
| 4,031,891 | 6/1977 | Jess | 604/126 |
| 4,223,695 | 9/1980 | Muetterties | 604/126 |
| 4,298,358 | 11/1981 | Ruschke | 604/126 |
| 4,671,331 | 6/1987 | Pruden | 215/DIG. 3 |

*Primary Examiner*—Stephen Marcus
*Assistant Examiner*—Nova Stucker
*Attorney, Agent, or Firm*—Michael L. Harrison

[57] ABSTRACT

A medicament vial safety cap which may be formed integrally at the time of manufacture of the medicament vial or added as an accessory to an existing conventional medicament vial allows an equalization of pressure to occur within a chamber adjacent to the stopper of the vial so that aerosolization of medicaments does not occur as a hypodermic needle is inserted or withdrawn from the vial. A hydrophobic filter, communicating between the vial safety chamber and the ambient, allows the pressure equalization to occur while trapping molecules of medicament inside the chamber.

2 Claims, 9 Drawing Sheets

A-A

MEDICAMENT VIAL SAFETY CAP

BACKGROUND OF THE INVENTION

1. Field of the Invention

The present invention relates to medicament containers and, in particular, to aerosol protection guards for medicament containers having pierceable, self-sealing tops adapted for repeatable filling of hypodermic syringes by inserting needles through the top.

2. Prior Art

A problem of growing concern among health care workers is the risk of injury and disease resulting from the handling and inadvertent contamination of, or by, aerosolized drugs, especially those having high levels of toxicity such as certain cancer chemotherapy drugs. The degree of risk to workers handling these cytotoxic drugs is dependent upon the drugs' inherent toxicity and the extent to which workers are exposed to the drugs. For some drugs the degree of toxicity from accidental dosages is not well understood or known, and the effects of slight exposure over long time periods are unpredictable. It is, therefore, advantageous to those handling these drugs to take all precautions against contamination, even in cases where the drugs have no known toxicity or are of unpredictable toxicity.

Exposure to toxic drugs can be a result of inhalation of airborne dusts from recrystalized drugs or of airborne droplets, absorption of drugs through the skin from accidental contact, and ingestion of drugs with food, beverages, and the like which have been contaminated through accidental contact with the drug.

In some treatment centers the drugs are prepared in the pharmacy by pharmacy personnel. In others, they are prepared by physicians or nurses.

Most cytotoxic drugs must be dissolved, which involves transferring a solvent from one container to another, before they are administered. Contamination can occur during either preparation or administration of the drugs by either direct contact with the drug or by inhalation. Ingestion can also occur because of the drugs contact with food or beverages in the area.

Drugs may be inadvertently released into the atmosphere by way of spraying or aerosolization, which can occur both upon (a) withdrawal of needles from drug vials or (b) during the expulsion of air from drug-filled syringes, among others.

A person may come into contact with an aerosolized drug directly or indirectly, as a result of coming into contact with particles that have come to rest on surfaces.

To avoid contact with the drug under the circumstances described above, it is recommended that these drugs be handled in biological safety cabinets, the personnel handling the drugs be clothed in protective clothing and gloves, and the preparation areas be ventilated by means of withdrawing potentially contaminated air away from personnel and from other areas.

In comparison to spilling, aerosolization is a far more serious hazard because its presence may be invisible, and undetectable without recourse to elaborate testing. The aerosol is easily transported by air currents to other areas where its presence, and consequent contamination, is not even suspected. It is, therefore, necessary to contain aerosolized medicaments in order to prevent the problem in the first place.

Among the various attempts which have been made to protect workers from coming into contact with aerosolized drugs are the use of glove boxes, laminar flow hoods, protective clothing, gloves and face shields Most recently, the use of special needle apparatuses such as, e.g., the "Minispike" (TM) manufactured by Burron Medical, Inc., have been employed to aid in equalization of pressure within medicament vials.

Patented inventions aimed at shielding the worker from aerosolized drugs by means of containment of the aerosol within a cavity are numerous. U.S. Pat. No. 4,522,277 issued Nov. 12, 1985, is typical. It includes a collapsible chamber which may be either of a bag-like balloon or a telescopically collapsible shield which attaches to the top of a conventional medicament vial. No means for automatic equalization of pressure within the cavity is indicated.

U.S. Pat. No. 4,312,349 illustrates the use of a filter for filtering gases and fluids passing through a compartment. The device, however, does not provide a way of equalizing pressure between the vial and ambient, and, in case of careless use could actually result in increased pressure within the vial.

All of the prior art devices for shielding medicament vial openings suffer from lack of an effective means for equalizing pressure in the vial between the vial and ambient. As long as any pressure differential exists, however slight, an aerosolization of drugs will occur when the needle is withdrawn from the vial.

Therefore, there is a need for a medicament vial shield which traps the aerosol molecules inside the vial and which allows for equalization of pressure between the vial interior and ambient

SUMMARY OF THE INVENTION

To meet this and other needs, it is an object of the present invention to provide a medicament vial and shield combination capable of storing medicaments in a sterile environment, yet penetrable by needle for filling syringes, etc., but having the ability to trap aerosolized drugs in a chamber without the chamber having an increase in pressure and thereby further aerosolizing the medicament to the environment.

It is another object of the present invention to provide a protective shield for use with medicament vials, for inserting or withdrawing medicaments and mixtures thereto by means of a hypodermic syringe.

It is a further object of the present invention to provide a shield device which is disposable.

It is yet a further object of the present invention to provide a shield device which is manufactured in combination with a medicament vial.

The present invention accomplishes the above and other objects by providing a shield adapted to the neck of a conventional medicament vial comprising a first membrane for sealing the medicament vial, a second membrane for creating a chamber between the second membrane and the first membrane and a filter for providing a path for ambient air into and out of the chamber. Also, the present invention blocks the transmission of fluids through the filter, while the pressure within the vial is maintained in equilibrium with the atmospheric pressure surrounding the vial so that aerosolization of medicaments during insertion and withdrawal of a needle into the vial, is minimized.

BRIEF DESCRIPTION OF THE DRAWINGS

The features and the advantages of the present invention are described more completely below in conjunction with the accompanying drawings in which like parts are identified by like numerals and wherein.

DESCRIPTION OF THE PREFERRED EMBODIMENT

Figure 7:
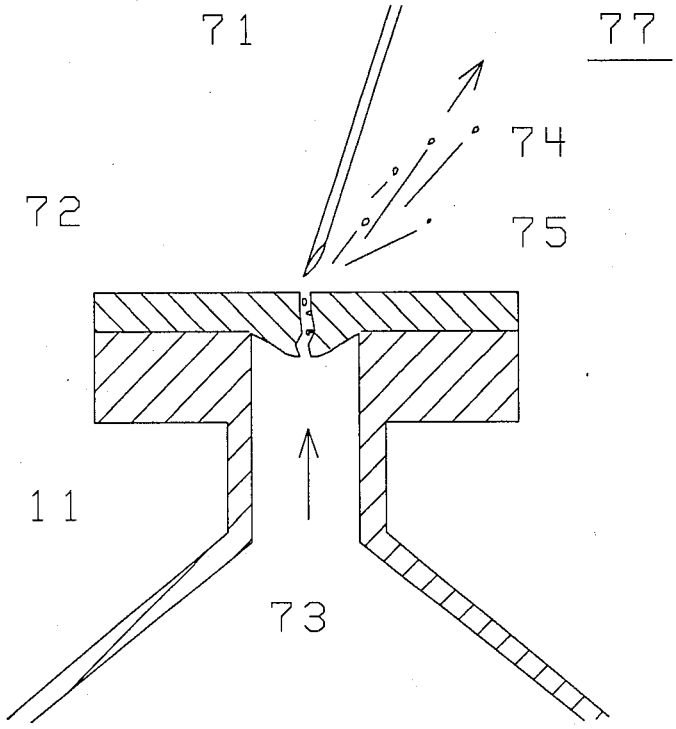
FIG. 7 illustrates the problem of aerosolization caused by the lack of equilibrium between ambient air and the air entrapped within the vial upon insertion or withdrawal of a hypodermic needle.

Referring first to FIG. 7, there is shown an illustration of the problem toward the solution of which the present invention is directed. Hypodermic needle 71 is shown being withdrawn from the cap 72 of a medicament vial 11 (shown partially) of conventional construction. In the interior 73 of the vial a pressure is assumed to have been created, due perhaps to injection of additional fluids into the vial for the purpose of mixing the medicament, adding a solute, or for similar reasons. Upon withdrawal of the needle 71, small droplets 74 of the medicament are deposited in the opening 75 produced by the penetration of the needle 71 and are expelled forcefully by air flow in the direction of the arrows caused by the higher pressure within the vial interior 73. Upon expulsion at the tip of the needle as the tip of the needle is withdrawn the force of expulsion and the velocity of the air, although minute in quantity, aerosolizes the particles 74 producing a fine, perhaps even invisible mist 77. As the mist is of extremely fine particles, it may be transported on air currents, even of very low velocity, over a wide range of space. Ultimately, the particles will recrystalize out onto surfaces, being most heavily concentrated, of course, in the area where the initial aerosolization takes place.

As the aerosol settles in the area where the medicament vials are most commonly and frequently used, the surface areas in the vicinity of this operation become contaminated. Upon contamination, a fine dust of the medicament may eventually form, which can be picked up by contact with workers' skin, clothing, and due to carelessness, ingested by becoming deposited upon foods, beverages, and the like.

Figure 1A:
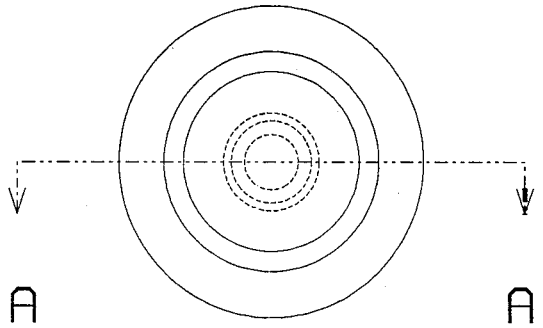
FIG. 1 illustrates a medicament vial having an integral aerosolization shield in accordance with the present invention.
Figure 1B:
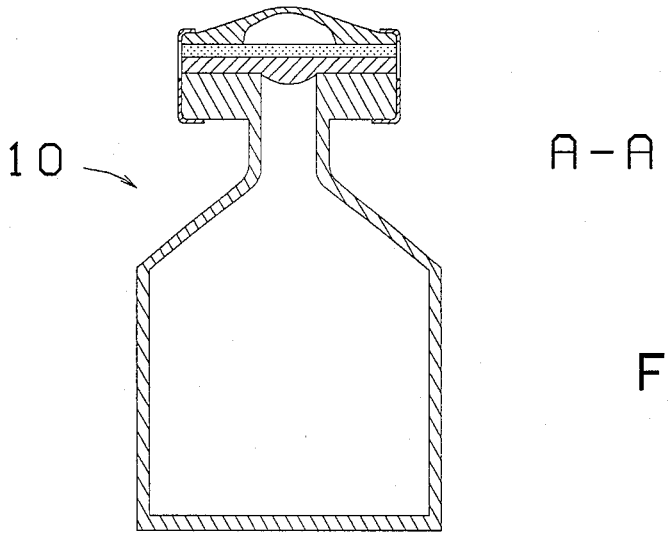
Figure 2:
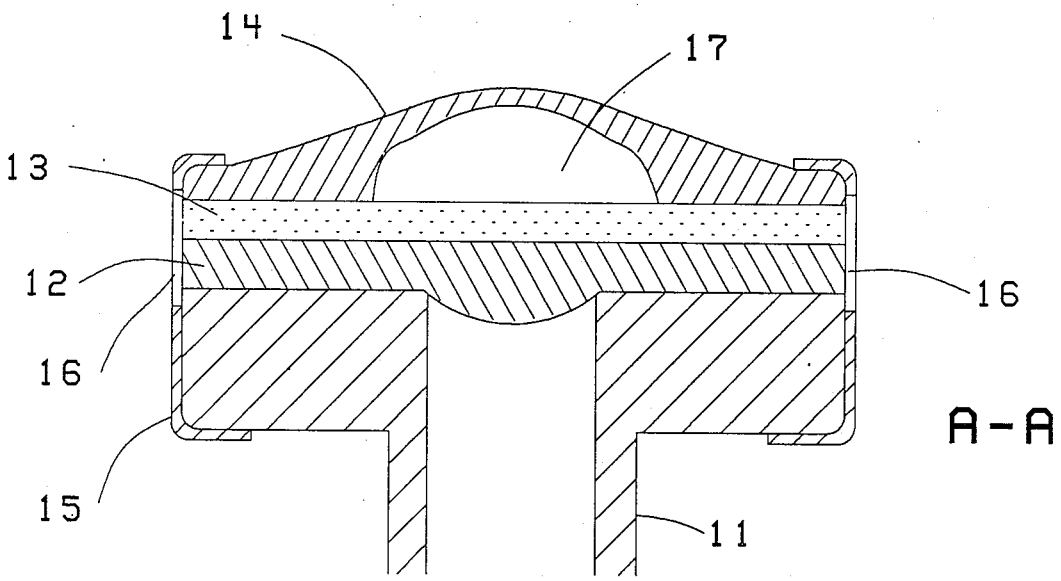
FIG. 2 is a detailed view of the cap and guard portion of the vial of FIG. 1 in accordance with the present invention.

A shield device, suitable for entrapping the majority of the aerosolized particles within the shield, would aid in the reduction of the aerosol contamination. A shield device suitable for this purpose is shown in overview in FIG. 1 and in detail in FIG. 2. Referring now primarily to FIG. 2 in the figure, a conventional vial 11 is shown outfitted with a stopper 12 of conventional shape and size and additional elements of filter 13 and protective stopper 14. The elements are held in place, in a manner which is conventional, by an aluminum ring 15 which sandwiches elements 12, 13 and 14 together and clamps them firmly to the side of the vial. The ring 15 will preferably have at least one aperture 16 communicating with the outside air whereby air may flow into and from the area of the filter washer 13.

The shape of the protective stopper 14 and/or the shape of the primary stopper 12, in conjunction, form a chamber having dimensions of slightly less than one centimeter in height and diameter at the opening of the vial. As a needle is withdrawn from the primary stopper 12, as depicted in FIG. 7, pressure within the vial 11 will produce aerosolization of the medicament which is at the tip or on the sides of the needle as it is withdrawn. In the device of FIG. 1 and 2, however, the tip of the needle will be entirely enclosed within the chamber 17 formed by the protective stopper 14, the primary stopper 12 and filter 13, as previously described. Due to the fact that the filter 13 allows air to communicate with the outside ambient, the pressure within the chamber 17 is maintained at ambient conditions. Temporary disturbances in the pressure are quickly equalized by flow of the air through the filter 13, either in a direction toward, or away, from the interior of the medicament vial, depending upon which way the pressure difference between the interior and the ambient is imbalanced.

Filter 13 is chosen to have a pore size which will entrap molecules as large as those of the medicament but will not trap air molecules. Thus, the aerosolized particles cannot escape through the filter, although air molecules can.

A suitable material for the filter is a hydrophobic filter material such as the PTFE filter material produced by Sartorious Inc. under the trade name Sartoflour II.

The embodiment shown in FIGS. 1 and 2 is preferably to be integrally manufactured along with the vial, and distributed as a single article of commerce. For use with conventional vials having a conventional single layer stopper, an accessory style of vial guard is provided for attachment to standard vials, as is described below.

Figure 3:
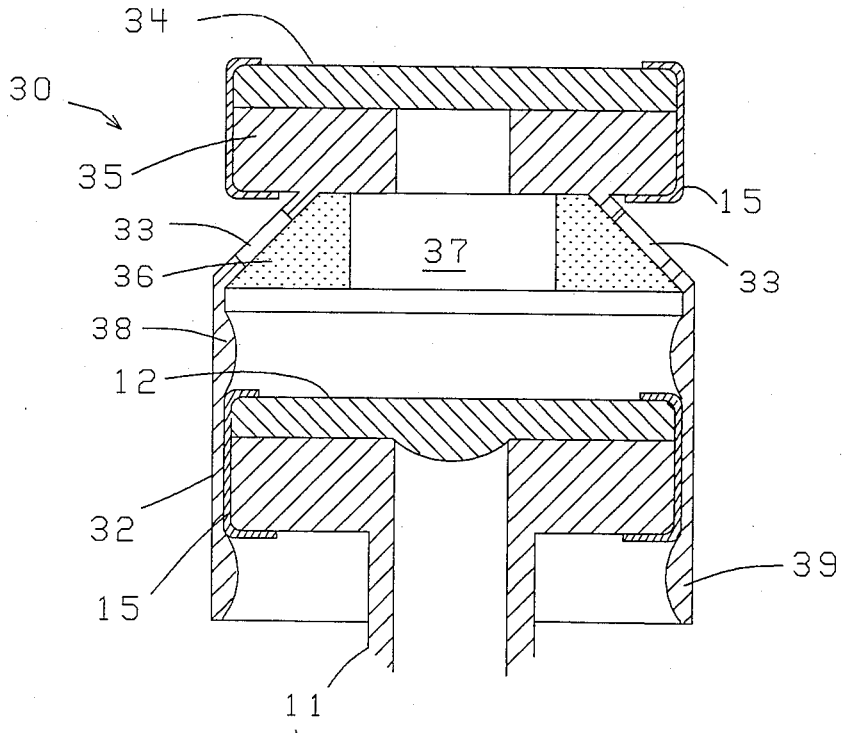
FIG. 3 depicts an accessory medicament vial guard for attachment to a standard vial, in accordance with the present invention.

Referring now to FIG. 3, there is shown an embodiment of the invention described above in which a protective shield 30 is adapted for fitment to a medicament vial 11 of conventional style. The conventional stopper 12 performs its conventional function. The protective stopper 34 is flat as opposed to the dome-shaped stopper 14 shown in FIG. 1, since the body 32 of the guard 30 itself forms a chamber for equalization of pressure.

The skirt 32 of the guard 30 forms an airtight friction fit with the metal cap 15 of the conventional vial 11. The equalization chamber 37 formed thereby communicates with the ambient air through a filter 36 which is shaped to fit the interior walls of the cap 30.

Shoulder band 38 limits movement of the shield 30 in a direction downward toward the vial 11. Shoulder band 39 similarly limits movement of the shield 30 in a direction upward from the vial 11. The combination of both shoulder bands 38 and 39 secure the shield 30 in a fixed position on the vial 11. The shoulder bands are preferably made with shallow protrusions and smoothly rounded edges, as shown, both to facilitate release of the shield 30 from its mold at the time of manufacture, and to facilitate the attachment of the shield 30 to the vial 11. The smooth transition not only makes it possible to slide the shield onto the vial, but also provides an automatic adjustment of its position. Instead of a continuous shoulder band, the affixation of the shield to the vial may also be accomplished by way of discreet shoulder tabs located at suitable positions around the interior of the shield 30.

Communication with ambient air through the filter 36 may be accomplished by providing ventilating ports 33 spaced around the periphery of the neck of the guard 30. The filter material, as is the case for all embodiments, has the same characteristics as described above in conjunction with FIG. 2.

Figure 4:
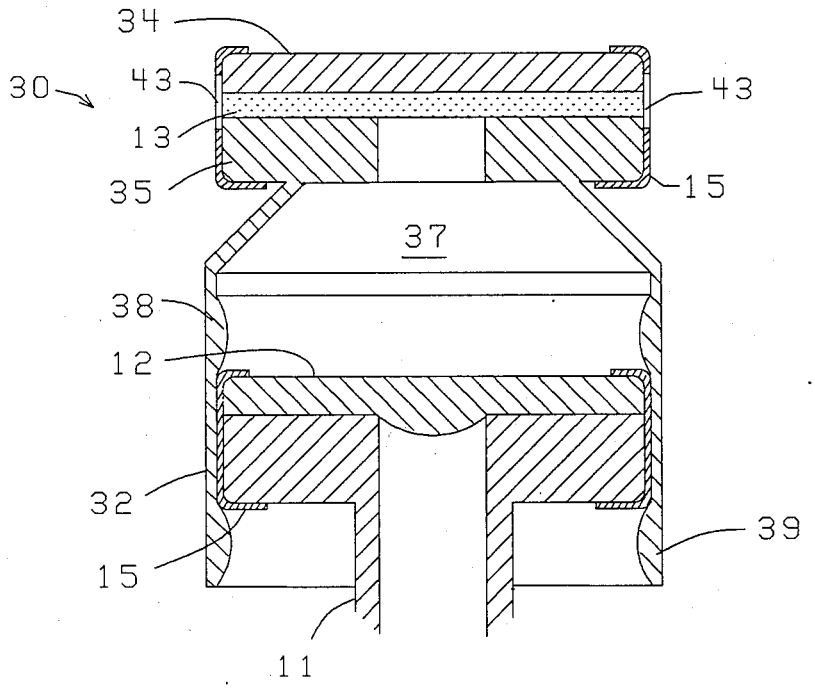
FIG. 4 illustrates an additional embodiment of an accessory guard in accordance with the present invention.

In FIG. 4 there is shown a design for an accessory medicament vial safety cap similar to that described in conjunction with FIG. 3 above. In FIG. 4 the conventional stopper 12 performs its conventional function and as in the case of FIG. 3, the body of the guard 30 forms a chamber 37 for equalization of pressure.

The accessory medicament vial of FIG. 4 differs from that of FIG. 3 in the placement of the filter In FIG. 3 the filter is placed within the body and covers ports in the neck of the accessory cap as it narrows to fit the top flange 35. The filter 13 communicates with the interior 37 through an aperture in the cap and communicates with the ambient atmosphere through ports 43 located in the band which clamps the upper stopper 34, the filter and the flange 35 of the accessory cap 30 together. The accessory cap 30 is held onto the vial 11 as described in conjunction with FIG. 3.

Figure 5:
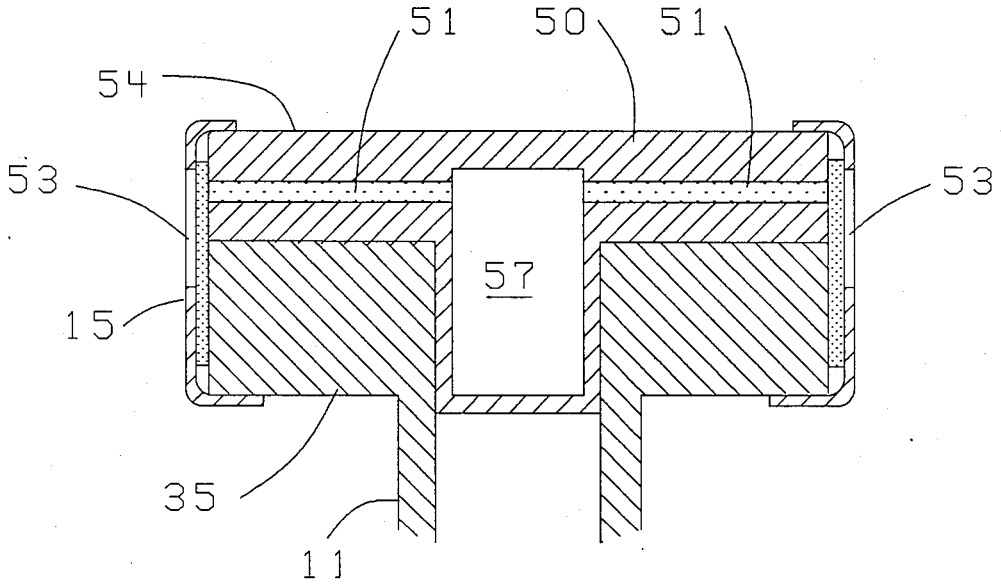
FIG. 5 illustrates a stopper in accordance with the present invention for use as either an integral guard or an accessory guard.

In FIG. 5 there is shown a design for a single piece stopper having in integrally formed chamber, which may be used in place of the standard stopper 12 shown in FIGS. 1, 2, and 3. The stopper is provided with ventilating holes 51 which allow the chamber to communicate with the ambient air. To prevent aerosol escape from the chamber, the holes are covered at some point in their length by a hydrophobic filter material as described above.

In the embodiment shown, the chamber 57 communicates with the ambient atmosphere by means of ducts 51 which are covered by filter 54 which surrounds the periphery of the cap. The atmosphere communicates through the filter by means of ports 53 in the band 15 which maintains the medicament vial 11 in contact with the stopper 50, with the ducts 51, and with the filter 54.

Figure 6A:
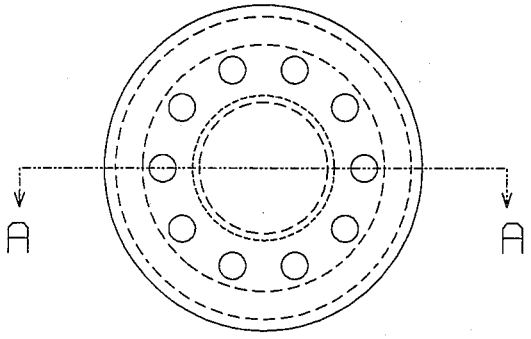
FIG. 6A is the top view of another version of an accessory guard in accordance with the present invention.
Figure 6B:
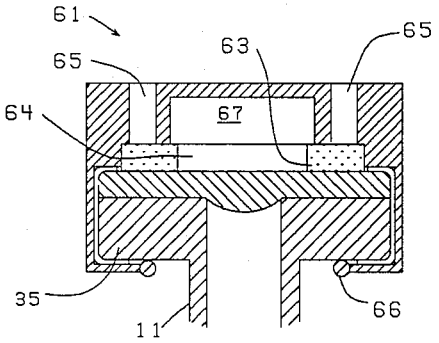
FIG. 6B is a section view through lines A—A of FIG. 6A of the accessory guard in accordance with the present invention, mounted on a standard vial.

In FIG. 6 there is shown still another accessory medicament vial safety cap 61 of a type which may be fabricated primarily from elastic material such that the elasticity of the material itself maintains the stopper in contact with the vial 11 and maintains a filter element in place. Filter element 63 is sandwiched on the top of a conventional medicament vial having conventional construction. An aperture 64 in the filter allows the needle to enter the vial without penetrating the filter itself. The accessory shield forms a cavity 67 in conjunction with the conventional top. Atmospheric pressure imbalance may be equalized by air flow through ports 65, visible in section in view A—A in FIG. 6B, and through filter material 63 to the interior of the chamber 67.

Elastic skirt 66 is made to be a size slightly smaller than the dimensions of the medicament vial cap, and accordingly, is maintained in tension when skirt 66 is drawn down around the sides of the existing medicament vial flange 35 and clamp ring 15.

Figure 6C:
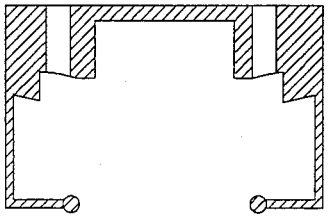
FIG. 6C is the accessory guard of FIGS. 6A and 6B in accordance with the present invention, shown detached from a medicament vial.

FIG. 6C illustrates that the cap is preferably manufactured having, in its relaxed or rest position, a greater thickness at the center of the cap than at the periphery. The effect of the raised area is to cause a greater clamping force to be exerted on the filter 63 and the stopper 12 around the periphery of the equalization chamber 67, thereby maintaining a more effective seal.

Figure 8:
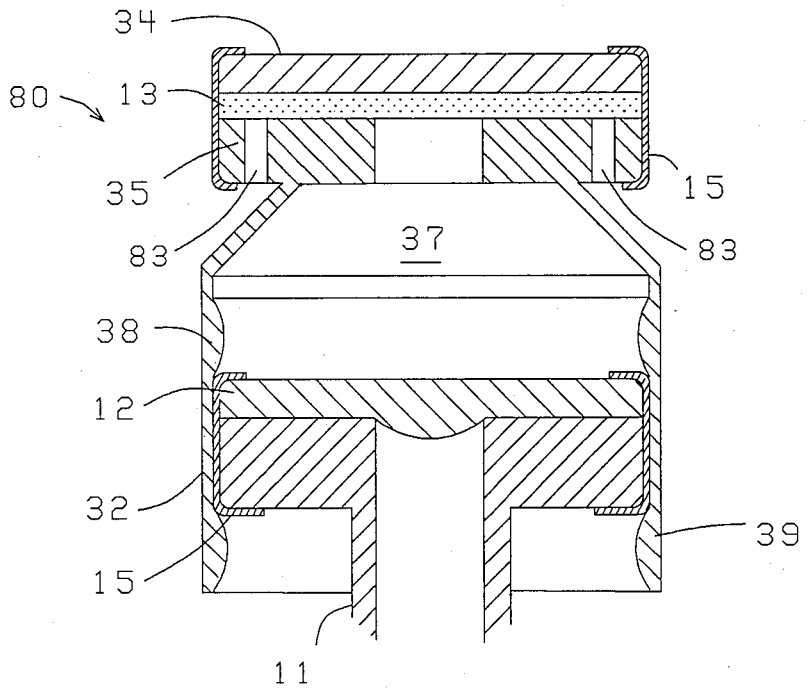
FIG. 8 depicts an accessory medicament vial guard in accordance with the present invention, having filtered ports integral to the flange of the vial.

In FIG. 8 there is shown an accessory medicament vial safety cap 80 designed along the lines of the medicament cap of FIG. 3. The medicament cap of FIG. 3 differs in that the chamber 37 communicates with the ambient through ports 33, whereas the medicament vial safety cap of FIG. 8 communicates through ports 83, which are formed in the top-most flange 35. In FIG. 8 the central opening to the chamber 37 through the flange 35 is covered by a hydrophobic filter 13 similar to the filters described above and a top safety cap 34. This sandwich of the filter 13 to the flange 35 allows communication of gases through the filter 13 and to the ambient through ports 83, while trapping molecules larger than the air molecules which allow the pressure equalization to occur. Other similarly marked elements of FIG. 8 function in a manner equivalent to that of FIG. 3.

Figure 9:
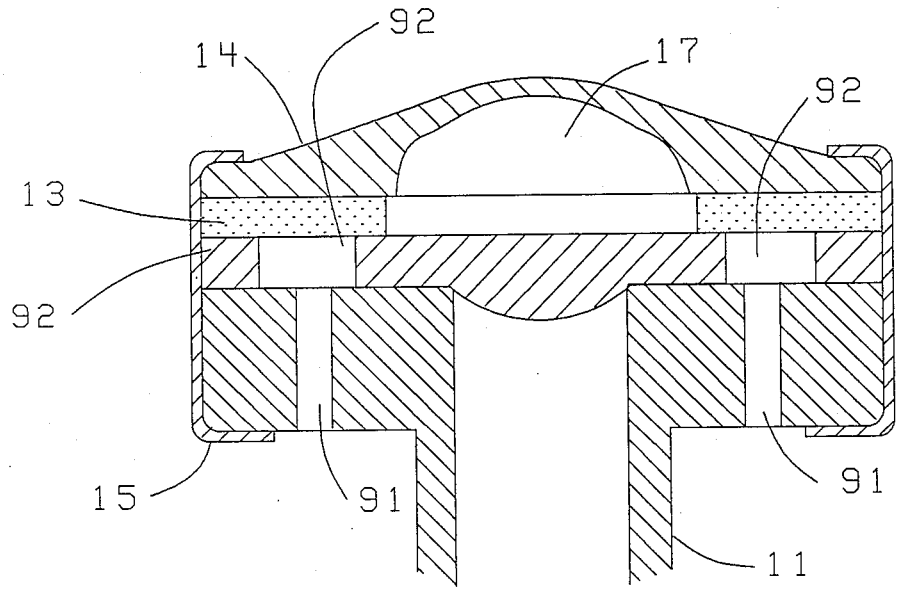
FIG. 9 illustrates a medicament vial with a self-contained aerosolization shield, having vertical filtered ports in the flange of the vial.

In FIG. 9 there is shown a medicament vial safety cap of a type intended for manufacture along with the vial itself. The embodiment shown in FIG. 9 is similar to the embodiment shown in FIG. 2, but differs in the manner of porting the interior of the chamber 17 to the ambient. In the embodiment of FIG. 9, the pressure in chamber 17 is equalized by a flow of air through filter 13, through access apertures 92 in the principal stopper 93, and through ports 91 in the flange of the medicament vial. This design may be easily manufactured using conventional vial packaging equipment, and requires but a slight modification to the design of the flange and of the primary stopper 93 of a conventional medicament vial.

Although specific embodiments of the present invention have been described and illustrated, it will be appreciated by those skilled in the art that many variations of the designs described can be practiced within the scope of the present invention, and that all such variations are contemplated within the teaching of the present invention. Accordingly, the scope of the invention is not limited to the specific embodiments shown, but is limited only by the scope of the following claims.

What is claimed is:

1. A medicament vial having protection against contamination due to aerosolization of medicaments upon inserting or withdrawing a hypodermic needle, comprising:

(a) a hollow vessel suitable for containment of fluids and having an opening;

(b) a first penetrable and resealable stopper, adjacent to and sealingly closing the opening, adapted for penetration by a hypodermic needle and, upon withdrawal of the needle, resealing;

(c) a second penetrable and resealable stopper, located adjacent to and approximately overlapping with the first stopper and being spaced, over at least a part thereof, away from the surface of the first stopper such that the first and second stopper form a vacant chamber;

(d) a hydrophobic filter element having an inside and an outside surface, the inside surface communicating with the chamber and the outside surface communicating with the ambient, whereby air flow through the filter can occur between the vacant chamber and the ambient, but having the characteristic that aerosolized particles of medicament will not pass through the filter.

2. A shield for medicament vials of the type having a penetrable and resealable first stopper adjacent to and sealingly closing the opening of the vial, said stopper being adapted to allow penetration by a hypodermic needle and, upon withdrawal of the needle, adapted to reseal, for providing protection against contamination due to aerosolization of medicaments upon inserting or withdrawing a hypodermic needle, comprising:

a generally hollow body of impervious material having a first opening adapted to attach the medicament vial in the vicinity of the first stopper and to seal against the medicament vial such that medicament cannot escape through the seal, and a second opening, generally aligned with the cap of the vial and preferably spaced apart from the first opening and parallel thereto; a second penetrable and resealable stopper, located adjacent to an approximately overlapping with the first stopper and being space away from the surface of the first stopper such that the first and second stopper along with the sides of the body form an enclosed vacant chamber;

a hydrophobic filter element having an inside and an outside surface, the inside surface communicating with the chamber and the outer surface communicating with the ambient, whereby air flow through the filter can occur between the enclosed vacant chamber and the ambient, but having the characteristic such that aerosolized particles of medicament will not pass through the filter.

* * * * *